US010073363B2

(12) United States Patent
Hirose et al.

(10) Patent No.: US 10,073,363 B2
(45) Date of Patent: Sep. 11, 2018

(54) PHOTOCONDUCTOR, IMAGE FORMING APPARATUS, PROCESS CARTRIDGE, AND METHOD OF MANUFACTURING PHOTOCONDUCTOR

(71) Applicants: Mitsuaki Hirose, Yamanashi (JP); Daisuke Kubo, Shizuoka (JP); Hiroshi Hashiguchi, Shizuoka (JP)

(72) Inventors: Mitsuaki Hirose, Yamanashi (JP); Daisuke Kubo, Shizuoka (JP); Hiroshi Hashiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 12 days.

(21) Appl. No.: 15/397,051

(22) Filed: Jan. 3, 2017

(65) Prior Publication Data

US 2017/0212435 A1 Jul. 27, 2017

(30) Foreign Application Priority Data

Jan. 21, 2016 (JP) ..... 2016-009533
Dec. 1, 2016 (JP) ..... 2016-234398

(51) Int. Cl.
*G03G 5/10* (2006.01)
*G03G 15/05* (2006.01)
*G03G 21/18* (2006.01)

(52) U.S. Cl.
CPC ..... *G03G 5/102* (2013.01); *G03G 5/101* (2013.01); *G03G 15/05* (2013.01); (Continued)

(58) Field of Classification Search
CPC ..... G03G 5/005; G03G 5/10; G03G 5/101; G03G 5/102; G03G 2215/00957
See application file for complete search history.

(56) References Cited

U.S. PATENT DOCUMENTS 5,272,508 A * 12/1993 Sakakibara ..... G03G 5/10 399/159
2008/0318142 A1 12/2008 Kawasaki et al.
(Continued)

FOREIGN PATENT DOCUMENTS

JP 05150571 A * 6/1993
JP 7-140680 6/1995
(Continued)

OTHER PUBLICATIONS

Sakamoto et al. (JP 07-140680 A), Jun. 1993, JPO Computer Translation.*

*Primary Examiner* — Erika J Villaluna
(74) *Attorney, Agent, or Firm* — Oblon, McClelland, Maier & Neustadt, L.L.P.

(57) ABSTRACT

A photoconductor is provided. The photoconductor includes a cylindrical conductive support, a water-repellent resin film, a coating film, and a flange. The cylindrical conductive support has an end part having an inner circumferential surface having a surface roughness Rz of from 3 to 10 μm. The water-repellent resin film is on the inner circumferential surface of the end part of the cylindrical conductive support. The coating film is on an outer circumferential surface of the cylindrical conductive support. The flange has a cylindrical fitting part having an outer circumferential surface secured to the inner circumferential surface of the end part of the cylindrical conductive support.

7 Claims, 4 Drawing Sheets

(52) U.S. Cl.
CPC ..... *G03G 21/1814* (2013.01); *G03G 2215/00957* (2013.01); *G03G 2221/183* (2013.01)

(56) References Cited

U.S. PATENT DOCUMENTS

| | | | | |
|---|---|---|---|---|
| 2010/0150606 | A1 | 6/2010 | Tamoto et al. | |
| 2010/0260513 | A1 | 10/2010 | Kawasaki et al. | |
| 2010/0330475 | A1 | 12/2010 | Tamoto et al. | |
| 2011/0059393 | A1 | 3/2011 | Tamoto et al. | |
| 2012/0114379 | A1* | 5/2012 | Yamashita ..... | G03G 5/00 399/159 |
| 2013/0059242 | A1 | 3/2013 | Asano et al. | |
| 2013/0243483 | A1 | 9/2013 | Hirose et al. | |
| 2013/0251401 | A1 | 9/2013 | Asano et al. | |
| 2013/0330104 | A1 | 12/2013 | Shimoyama et al. | |

FOREIGN PATENT DOCUMENTS

| | | |
|---|---|---|
| JP | 2000-275870 | 10/2000 |
| JP | 2009-063746 | 3/2009 |

* cited by examiner

PHOTOCONDUCTOR, IMAGE FORMING APPARATUS, PROCESS CARTRIDGE, AND METHOD OF MANUFACTURING PHOTOCONDUCTOR

CROSS-REFERENCE TO RELATED APPLICATIONS

This patent application is based on and claims priority pursuant to 35 U.S.C. § 119(a) to Japanese Patent Application Nos. 2016-009533 and 2016-234398, filed on Jan. 21, 2016 and Dec. 1, 2016, respectively, in the Japan Patent Office, the entire disclosure of each of which is hereby incorporated by reference herein.

BACKGROUND

Technical Field

The present disclosure relates to a photoconductor, an image forming apparatus, a process cartridge, and a method of manufacturing a photoconductor.

Description of the Related Art

Electrophotographic image forming apparatuses, such as laser printers and digital copiers, have been improved in terms of image quality and stability and widely spread recently. Such image forming apparatuses are generally equipped with an image bearer. The image bearer forms an electrostatic latent image on its surface by means of charging and light irradiation. The electrostatic latent image is thereafter developed into a visible image. Examples of the image bearer include electrophotographic photoconductors (hereinafter simply "photoconductors").

In particular, organic photoconductors using organic materials are widely used for their advantages in cost, productivity, material selectivity, and global environmental effect.

Most organic photoconductors have been produced by means of dip coating. However, dip coating has a drawback that a coating liquid is allowed to get into the internal space of a cylindrical conductive substrate and contaminate the inner circumferential surface thereof. This results in an inaccurate bonding of a flange to the cylindrical conductive substrate. To prevent this problem, the inner circumferential surface of the cylindrical conductive substrate is generally wiped off after the dip coating. However, the inner circumferential surface that has been wiped off with an organic solvent may cause the coating liquid to rise up, resulting in an uneven coating film.

SUMMARY

In accordance with some embodiments of the present invention, a photoconductor is provided. The photoconductor includes a cylindrical conductive support, a water-repellent resin film, a coating film, and a flange. The cylindrical conductive support has an end part having an inner circumferential surface having a surface roughness Rz of from 3 to 10 μm. The water-repellent resin film is on the inner circumferential surface of the end part of the cylindrical conductive support. The coating film is on an outer circumferential surface of the cylindrical conductive support. The flange has a cylindrical fitting part having an outer circumferential surface secured to the inner circumferential surface of the end part of the cylindrical conductive support.

In accordance with some embodiments of the present invention, an image forming apparatus is provided. The image forming apparatus includes the above photoconductor, a charger, an irradiator, a developing device, a transfer device, and a fixing device. The charger charges a surface of the photoconductor. The irradiator irradiates the charged surface of the photoconductor to form an electrostatic latent image thereon. The developing device develops the electrostatic latent image with a toner to form a toner image. The transfer device transfers the toner image from the photoconductor onto a recording medium. The fixing device fixes the toner image on the recording medium.

In accordance with some embodiments of the present invention, a process cartridge detachably mountable on an image forming apparatus is provided. The process cartridge includes the above photoconductor and at least one of a charger, a developing device, a transfer device, and a cleaner.

In accordance with some embodiments of the present invention, a method of manufacturing a photoconductor is provided. The method includes: processing an inner circumferential surface of an end part of a cylindrical conductive support to have a surface roughness Rz of from 3 to 10 μm; forming a water-repellent resin film on the inner circumferential surface of the end part of the cylindrical conductive support; forming a coating film on an outer circumferential surface of the cylindrical conductive support; and securing an outer circumferential surface of a cylindrical fitting part of a flange to the inner circumferential surface of the end part of the cylindrical conductive support.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
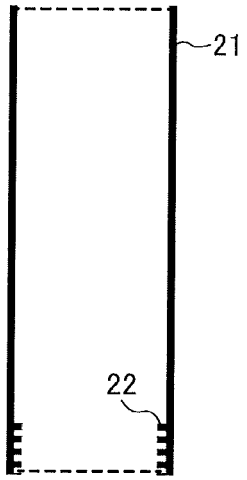
FIG. 1 is a cross-sectional view of a cylindrical conductive support of a photoconductor according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

There have been several attempts to remove contamination on an edge face of a coating surface without using any organic solvent. One attempt involves scraping off a coating liquid remaining on an inner circumferential surface with an elastic member. Another attempt involves forming a fluorine coating on a region where a coating liquid is not to be applied, to prevent the coating liquid from adhering to that region.

In a case in which a flange is press-fitted to a cylindrical conductive substrate having a fluorine coating on its inner circumferential surface and bonded thereto with an adhesive, the adhesion strength between the flange and the conductive substrate is so poor that the flange may be caused to idly rotate when the photoconductor is driven to form an image.

In view of this situation, some embodiments of the present invention provide a photoconductor in which a flange and a cylindrical conductive support are securely attached to each other. Such a photoconductor is manufactured through a process that does not contaminate the inner circumferential surface of the cylindrical conductive support. Such a photoconductor can reliably form images for an extended period of time.

The photoconductor according to some embodiments of the present invention includes a cylindrical conductive support (hereinafter may be simply referred to as "conductive support"). An inner circumferential surface of an end part of the cylindrical conductive support, to be brought into contact with a flange, has a surface roughness Rz of from 3 to 10 μm. In addition, a water-repellent resin film is disposed on the inner circumferential surface of the end part of the cylindrical conductive support. This configuration prevents the inner circumferential surface of the cylindrical conductive support from being contaminated with a coating liquid in the process of dip coating, and improves adhesion strength between the cylindrical conductive support and a flange.

The photoconductor according to some embodiments of the present invention is manufactured by: processing an inner circumferential surface of an end part of a cylindrical conductive support to have a surface roughness Rz of from 3 to 10 μm; forming a water-repellent resin film on the inner circumferential surface of the end part of the cylindrical conductive support; forming a coating film on an outer circumferential surface of the cylindrical conductive support; and securing an outer circumferential surface of a cylindrical fitting part of a flange to the inner circumferential surface of the end part of the cylindrical conductive support.

Conductive Support

The conductive support may be made of a conductive material having a volume resistivity not greater than $10^{10}$ Ω•cm. Examples of the conductive support include plastic or paper cylinders coated with a metal (e.g., aluminum, nickel, chromium, nichrome, copper, gold, silver, and platinum) or a metal oxide (e.g., tin oxide and indium oxide) by means of deposition or sputtering. Examples of the conductive support further include plates of metals (e.g., aluminum, aluminum alloy, nickel, and stainless steel) and cylinders of such metals, prepared by tubing a metal by extrusion or drawing, cutting, super finishing, and polishing the tube.

The inner circumferential surface of the end part of the conductive support, on which a water-repellent resin film is formed, has a surface roughness Rz of from 3 to 10 μm, more preferably from 5 to 8 μm. If the surface roughness Rz is less than 3 μμm, when a flange is fitted to the conductive support with an adhesive after a water-repellent resin film has been formed on the inner circumferential surface of the conductive support, the adhesive will cause repelling to reduce the adhesion strength between the flange and the conductive support. If the surface roughness Rz is in excess of 10 μm, when a flange is fitted to the conductive support with an adhesive after a water-repellent resin film has been formed on the inner circumferential surface of the conductive support, the flange will contact the conductive support non-uniformly, resulting in poor run-out in fitting the flange. When the inner circumferential surface of the end part of the conductive support, on which a water-repellent resin film is formed, has a surface roughness Rz of from 3 to 10 μm, a flange can be fitted to the conductive support with an improved adhesion strength. The surface roughness of the water-repellent resin film formed on the inner circumferential surface of the the end part of the conductive support reflects that of the inner circumferential surface of the end part of the conductive support itself having the water-repellent resin film thereon.

Figure 7:
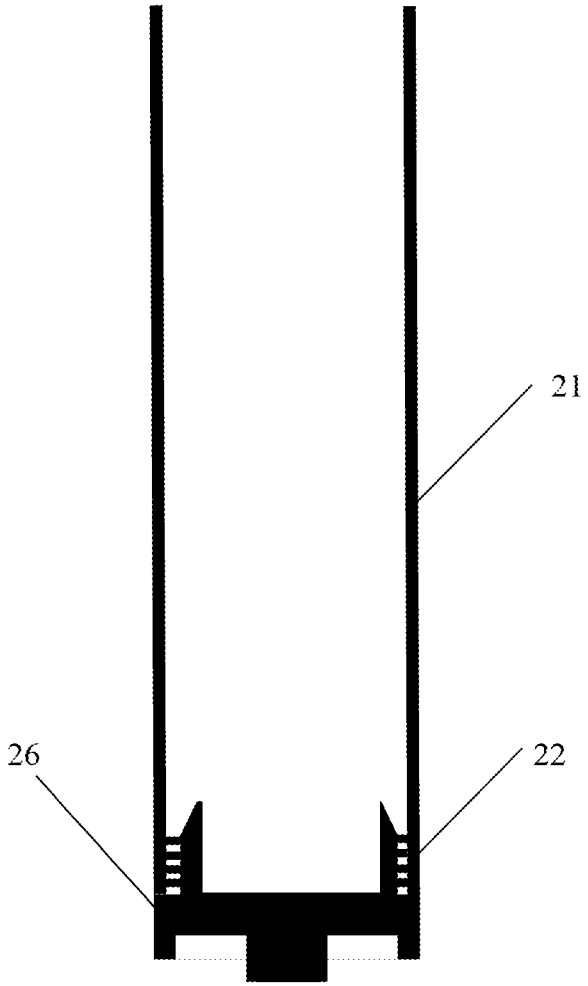
FIG. 7 is schematic cross-sectional view of a flange brought into contact with the inner circumferential surface of the end part of the cylindrical conductive support according to an embodiment of the present invention.

The surface roughness Rz of from 3 to 10 μm can be achieved by cutting processing or polishing processing. Referring to FIG. 1 and FIG. 7, a processed part 22 of the inner circumferential surface of a conductive support 21 has a length of about 50 mm when measured from one end of the conductive support 21 subjected to dipping, since the part of the conductive support 21 to be brought into contact with the flange 26 has a length of about 50 mm when measured from that end. However, the length of the processed part 22 can be varied depending on the amount of a coating liquid that may get into the internal space of the conductive support 21 in the process of dipping.

In the present disclosure, the surface roughness Rz refers to "ten point height of roughness profile (Rz)" defined in JIS B 0601-1982, and is measured with a surface roughness meter (SURFCOM 1400D available from Tokyo Seimitsu Co., Ltd.) according to a method based on JIS B 0601-1982. Specifically, a ten point height of roughness profile is the sum of the average peak among the highest to the fifth highest peaks in a surface roughness profile and the average depth among the deepest to the fifth deepest valleys in the surface roughness profile. Five randomly selected points on a photoconductor are subjected to the measurement of ten point height of roughness profile. The average of the five measured values is determined as the surface roughness Rz of the photoconductor. The surface roughness meter SURFCOM 1400D (available from Tokyo Seimitsu Co., Ltd.)

may be replaced with any other measuring equipment compliant with JIS standard that can perform the same measurement.

Water-Repellent Resin Film on Inner Circumferential Surface of Conductive Support A water-repellent resin film is formed on an inner circumferential surface of an end part of the conductive support, to be brought into contact with a flange 26. Specifically, first, the inner circumferential surface of the end part of the conductive support, to be brought into contact with a flange 26, is processed to have a surface roughness Rz of from 3 to 10 μm. Next, after the conductive support is cleaned, a water-repellent resin coating liquid is applied to the inner circumferential surface of the end part of the conductive support and dried. One method of applying the water-repellent resin to the inner circumferential surface of the conductive support 21 includes pressing a sponge 23 impregnated with the water-repellent resin against the inner circumferential surface of the conductive support 21, but is not limited thereto.

Specific examples of the water-repellent resin include, but are not limited to, fluororesin and silicone-oil-added resin.

Specific examples of the fluororesin include, but are not limited to, polytetrafluoroethylene, polychlorotrifluoroethylene, and polyvinylidene fluoride. Specific examples of the silicone-oil-added resin include, but are not limited to, resins to which dimethyl silicone oil or methyl phenyl silicone oil has been added. Preferably, the addition amount (rate) of the silicone oil is about 0.1% to 1% by mass based on the base resin. The base resin of the silicone-oil-added resin is selected from resins that do not dissolve in an undercoat layer coating liquid and/or a photosensitive layer coating liquid. Specific examples of such resins include, but are not limited to, nylon resin, polyamide resin, polyurethane, epoxy resin, acrylic resin, and polyvinyl butyral.

Preferably, the water-repellent resin film has a thickness of about 0.1 to 1 μm. After being applied to the inner circumferential surface of the conductive support, preferably, the water-repellent resin is subjected to a drying for about 10 to 60 minutes at about 100° C. to 150° C., to become a resin film.

Coating Film

The photoconductor according to some embodiments of the present invention includes a coating film on an outer circumferential surface of the conductive support.

The coating film generally includes a photosensitive layer (e.g., a charge generation layer, a charge transport layer). Optionally, an undercoat layer is provided between the conductive support and the photosensitive layer, and/or a surface layer is provided on the photosensitive layer.

As the coating film is formed on the outer circumferential surface of the conductive support after the water-repellent resin film has been formed on the inner circumferential surface of the end part of the conductive support, to be brought into contact with the flange, the inner circumferential surface of the conductive support is prevented from being contaminated with a coating liquid at the time when the coating film is being formed.

Formation of Photosensitive Layer

Figure 3:
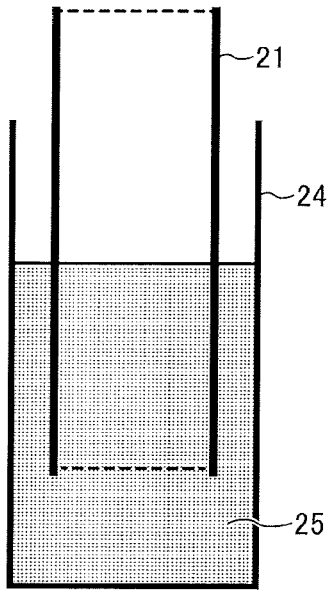
FIG. 3 is an illustration for explaining a method of forming a coating film on an outer circumferential surface of the cylindrical conductive support illustrated in FIG. 1.

In accordance with some embodiments of the present invention, a photosensitive layer is formed by dip coating. FIG. 3 is an illustration for explaining dip coating according to some embodiments of the present invention. The conductive support 21 is dipped into a coating vessel 24 containing a coating liquid 25 and drawn up thereafter, thus forming a coating film on an outer circumferential surface of the conductive support 21. The coating vessel 24 may be equipped with a circulator and/or a filtering apparatus. Preferably, the coating film is subjected to drying so that solvents are removed therefrom. Depending on the materials included in the photosensitive layer, preferably, the drying is performed at about temperatures of 100° C. to 150° C. for about 10 to 60 minutes.

Layer Structure of Photoconductor

Figure 4A:
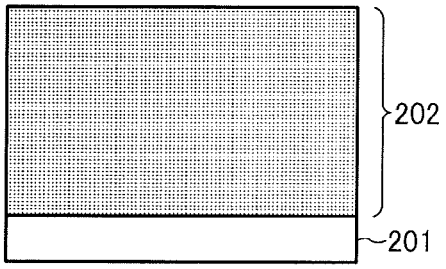
FIGS. 4A and 4B are cross-sectional views of photoconductors according to some embodiments of the present invention.
Figure 4B:
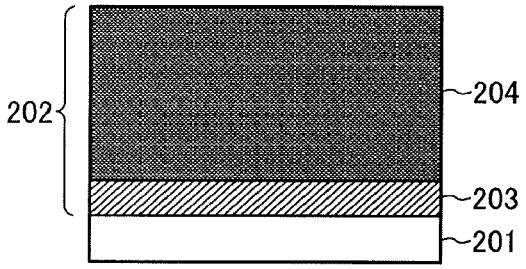

FIGS. 4A and 4B are cross-sectional views of photoconductors according to some embodiments of the present invention.

Referring to FIG. 4A, a photoconductor includes, from the innermost side thereof, a conductive support 201 being cylindrical and a photosensitive layer 202. Referring to FIG. 4B, a photoconductor includes, from the innermost side thereof, a conductive support 201 being cylindrical, a charge generation layer 203, and a charge transport layer 204.

The photoconductor illustrated in FIG. 4A includes a single-layer photosensitive layer 202. The photoconductor illustrated in FIG. 4B includes a multilayer photosensitive layer 202 in which the charge generation layer 203 and the charge transport layer 204 are laminated.

These photoconductors may further include an undercoat layer between the conductive support 201 and the photosensitive layer 202, for improving charging performance and suppressing the occurrence of background fog. The undercoat layer may be either single-layer or multilayer. These photoconductors may further include a surface layer on the photosensitive layer 202 (or the charge transport layer 204).

The above-described layer structures are only for illustration purpose. The layer structure of the photoconductor is not limited to those described above.

Photosensitive Layer

As described above, the photosensitive layer may be either single-layer or multilayer.

A multilayer photosensitive layer includes a charge generation layer and a charge transport layer having a charge generation function and a charge transport function, respectively. A single-layer photosensitive layer has both a charge generation function and a charge generation function at the same time. Details of multilayer photosensitive layers and single-layer photosensitive layers are described below.

Multilayer Photosensitive Layer

Charge Generation Layer

The charge generation layer includes a charge generation material having a charge generation function as a main component, and optionally includes a binder resin. Examples of the charge generation material include organic materials.

Specific examples of the organic charge generation materials include, but are not limited to, phthalocyanine pigments such as metal phthalocyanine and metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone and polycyclic quinone pigments, quinone imine pigments, diphenylmethane and triphenylmethane pigments, benzoquinone and naphthoquinone pigments, cyanine and azomethine pigments, indigoid pigments, and bisbenzimidazole pigments. Each of these charge generation materials can be used alone or in combination with others.

Specific examples of the binder resin optionally included in the charge generation layer include, but are not limited to, polyamide, polyurethane, epoxy resins, polyketone, polycarbonate, silicone resins, acrylic resins, polyvinyl butyral, polyvinyl formal, polyvinyl ketone, polystyrene, poly-N-vinylcarbazole, and polyacrylamide. Each of these bonder resins can be used alone or in combination with others. Specific examples of the binder resin further include: polymeric charge transport materials having a charge transport function, such as polymers (e.g., polycarbonate, polyester, polyurethane, polyether, polysiloxane, acrylic resin) having an arylamine skeleton, a benzidine skeleton, a hydrazone skeleton, a carbazole skeleton, a stilbene skeleton, or a pyrazoline skeleton; and polymers having a polysilane skeleton.

The charge generation layer may further include a low-molecular-weight charge transport material. Examples of the low-molecular-weight charge transport material to be included in the charge generation layer include both hole transport materials and electron transport materials. Specific examples of the low-molecular-weight charge transport material include materials usable for the charge transport layer, to be described later.

The charge generation layer may be formed by dip coating.

Specifically, the charge generation layer may be formed from a dispersion liquid in which an inorganic or organic charge generation material has been dissolved in a solvent (e.g., tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate), optionally together with a binder resin, by a ball mill, attritor, sand mill, or bead mill. After being diluted moderately, the dispersion liquid is applied to the conductive support by dip coating, thus forming a charge generation layer.

The charge generation layer may further include a leveling agent such as dimethyl silicone oil and methyl phenyl silicone oil.

Preferably, the charge generation layer has a thickness of about 0.01 to 5 μm, more preferably 0.05 to 2 μm.

Charge Transport Layer

The charge transport layer has a charge transport function. The charge transport layer may be formed by applying a solution or dispersion, in which a charge transport material and a binder resin are dissolved or dispersed in a solvent, onto the charge generation layer, followed by drying.

Examples of the charge transport material include electron transport materials, hole transport materials, and charge transport materials. Examples of the charge transport materials include both hole transport materials and electron transport materials.

Specific examples of the electron transport materials include, but are not limited to, electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. Each of these electron transport materials can be used alone or in combination with others.

Specific examples of the hole transport materials include, but are not limited to, electron donating materials such as oxazole derivatives, oxadiazole derivatives, imidazole derivatives, monoarylamine derivatives, diarylamine derivatives, triarylamine derivatives, stilbene derivatives, a-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, distyrylbenzene derivatives, and enamine derivatives. Each these hole transport materials can be used alone or in combination with others.

Specific examples of usable binder resins include thermoplastic and thermosetting resins, such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin, and alkyd resin.

Preferably, the content of the charge transport material is from 20 to 300 parts by mass, more preferably from 40 to 150 parts by mass, based on 100 parts by mass of the binder resin. The polymeric charge transport material may be used either alone or in combination with the binder resin.

Specific examples of the solvent included in the charge transport layer coating liquid are the same as that included in the charge generation layer coating liquid. In particular, solvents capable of dissolving both the charge transport material and the binder resin are suitable. Each of the solvents can be used alone or in combination with others.

Other Additives

The charge transport layer may optionally include a plasticizer, a leveling agent, an antioxidant, a photostabilizer, and/or an ultraviolet absorber. Specific examples of the plasticizer to be included in the charge transport layer include, but are not limited to, dibutyl phthalate and dioctyl phthalate, that are known plasticizers generally used for resins. Preferably, the content of the plasticizer is about 0 to 30 parts by mass based on 100 parts by mass of the binder resin.

Specific examples of the leveling agent to be included in the charge transport layer include, but are not limited to, silicone oils such as dimethyl silicone oil and methyl phenyl silicone oil, and polymers or oligomers having a perfluoroalkyl-group-containing side chain. Preferably, the content of the leveling agent is about 0 to 1 part by mass based on 100 parts by mass of the binder resin.

Specific examples of the antioxidant include, but are not limited to, phenol compounds, paraphenylenediamines, hydroquinones, organic sulfur compounds, organic phosphor compounds, and hindered amines, that are effective for stabilizing electrostatic property.

Preferably, the charge transport layer has a thickness of about 5 to 40 μm, more preferably about 10 to 30 μm. The charge transport layer may be formed by the same coating method as the charge generation layer is formed.

Single-layer Photosensitive Layer

The single-layer photosensitive layer has both a charge generation function and a charge transport function at the same time. Such a single-layer photosensitive layer may be formed by dissolving or dispersing a charge generation material and a charge transport material having a charge generation function and a charge transport function, respectively, along with a binder resin, in a solvent, and applying the resulting solution or dispersion onto the conductive support, followed by drying.

The single-layer photosensitive layer may further include a plasticizer and/or a leveling agent. The charge generation material may be dispersed in the single-layer photosensitive layer in the same manner as in the charge generation layer. Specific examples of the charge generation material, charge transport material, plasticizer, and leveling agent to be included in the single-layer photosensitive layer include those described above for the charge generation layer and the charge transport layer.

Specific examples of the binder resin include those described above for the charge generation layer and the charge transport layer. Each of the binder resins can be used alone or in combination with others. In addition, the single-layer photosensitive layer may include the polymeric charge transport material described above. Preferably, the single-layer photosensitive layer has a thickness of about 5 to 40 μm, more preferably about 10 to 30 μm. The single-layer photosensitive layer may be formed by the same coating method as the charge generation layer is formed.

Attachment of Flange

In an image forming apparatus, the photoconductor is driven via a flange attached to the photoconductor. The flange is securely attached to the conductive support so as not to idly rotate. One method of securing the flange to the conductive support includes attaching the flange to the conductive support with an adhesive. Another method includes modifying the flange by attaching a metal plate having a claw thereto, and thereafter inserting the modified flange into the conductive support while the claw is expressing an anchor effect. Another method includes swaging the conductive support from outside after the flange has been fitted thereto. Among these methods, attaching with an adhesive is the cheapest, which is preferable.

Specific examples of the adhesive include, but are not limited to, instantaneous adhesives made of cyanoacrylate and aqueous adhesives made of vinyl acetate latex resins. Among these adhesives, instantaneous adhesives made of cyanoacrylate are preferable from the aspect of adhesion property.

The flange may be made of a resin material (e.g., polycarbonate, polyacetal, polystyrene, acrylonitrile butadiene styrene (ABS)) or a metallic material (e.g., aluminum, stainless steel (SUS)). From the aspect of moldability and cost, preferably, the flange is made of a resin material such as polycarbonate and polyacetal. In particular, polyacetal is cheaper. Even in a case in which the flange has poor compatibility with the adhesive, the flange and the conductive support can be secured to each other, in accordance with some embodiment of the present invention.

Image Forming Apparatus

An image forming apparatus according to an embodiment of the present invention includes: the photoconductor according to an embodiment of the present invention; a charger to charge a surface of the photoconductor; an irradiator to irradiate the charged surface of the photoconductor to form an electrostatic latent image thereon; a developing device to develop the electrostatic latent image with a toner to form a toner image; a transfer device to transfer the toner image from the photoconductor onto a recording medium; and a fixing device to fix the toner image on the recording medium.

Figure 5:
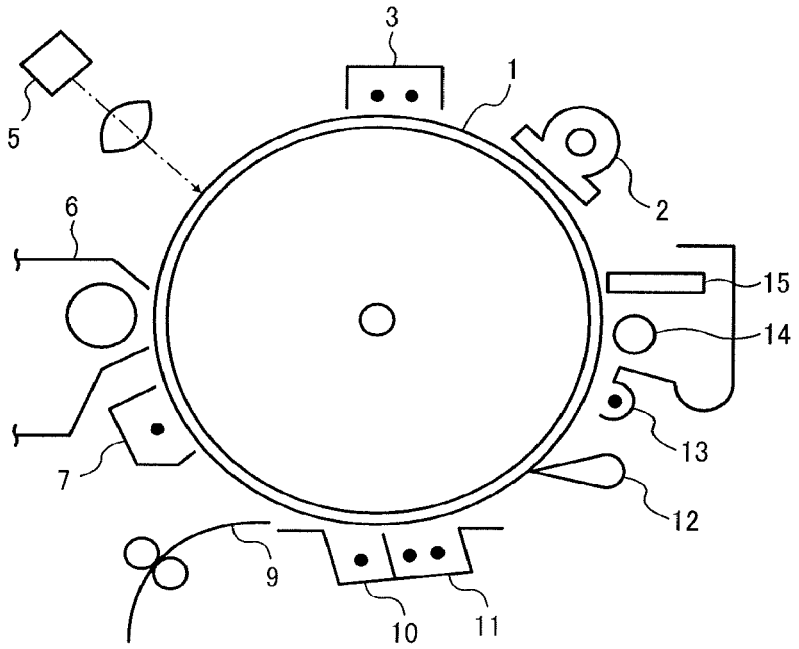
FIG. 5 is a schematic view of an image forming apparatus according to an embodiment of the present invention.

FIG. 5 is a schematic view of an image forming apparatus according to an embodiment of the present invention. A charger 3 uniformly charges a photoconductor 1. Specific examples of the charger 3 include, but are not limited to, a corotron device, a scorotron device, a solid-state discharging element, a multi-stylus electrode, a roller charging device, and a conductive brush device.

Next, an irradiator 5 emits light to the uniformly-charged photoconductor 1 to form an electrostatic latent image thereon. The irradiator 5 includes a light source. Examples of the light source include all luminous matters such as fluorescent lamp, tungsten lamp, halogen lamp, mercury lamp, sodium-vapor lamp, light-emitting diode (LED), laser diode (LD), and electroluminescence (EL). For the purpose of emitting light having a desired wavelength only, any type of filter can be used, such as sharp cut filter, band pass filter, near infrared cut filter, dichroic filter, interference filter, and color-temperature conversion filter.

Next, the developing unit 6 develops the electrostatic latent image formed on the photoconductor 1 into a toner image by a known developing method, such as a one-component developing method or a two-component developing method each using dry toner, and a wet drying method using wet toner. As the photoconductor 1 is positively (negatively) charged and irradiated with light thereafter, a positive (negative) electrostatic latent image is formed on the surface of the photoconductor 1. When the positive (negative) electrostatic latent image is developed with a negatively (positively) chargeable toner, a positive image is produced. By contrast, when the positive (negative) electrostatic latent image is developed with a positively (negatively) chargeable toner, a negative image is produced.

Next, a transfer charger 10 transfers the toner image from the photoconductor 1 onto a transfer medium 9. For the purpose of improving transfer efficiency, a pre-transfer charger 7 may be used in combination with the transfer charger 10. The transfer charger 10 may employ any transfer method, such as an electrostatic transfer method using a transfer charger or a bias roller; a mechanical transfer method such as an adhesive transfer method and a pressure transfer method; or a magnetic transfer method. In the electrostatic transfer method, the above-described charger can be used.

Next, a separation charger 11 and a separation claw 12 separate the transfer medium 9 from the photoconductor 1. The separation may also be performed by means of electrostatic adsorption induction separation, side-end belt separation, leading-end grip conveyance, or curvature separation. As the separation charger 11, the above-described charger can be used.

Next, a fur brush 14 and a cleaning blade 15 remove residual toner particles remaining on the photoconductor 1 without being transferred, thus cleaning up the photoconductor 1. For the purpose of improving cleaning efficiency, a pre-cleaning charger 13 may be used in combination. The cleaning may also be performed by a web-type cleaner or a magnetic-brush-type cleaner. Such cleaners can be used alone or in combination with others.

Optionally, a neutralizer removes residual latent images remaining on the photoconductor 1 thereafter. Specific examples of the neutralizer include, but are not limited to, a neutralization lamp 2 and a neutralization charger. As the neutralization lamp 2 and the neutralization charger, the above-described light source and charger, respectively, can be used.

Processes that are performed away from the photoconductor 1, such as document reading, paper feeding, fixing, paper ejection, can be performed by known means.

Process Cartridge

Figure 6:
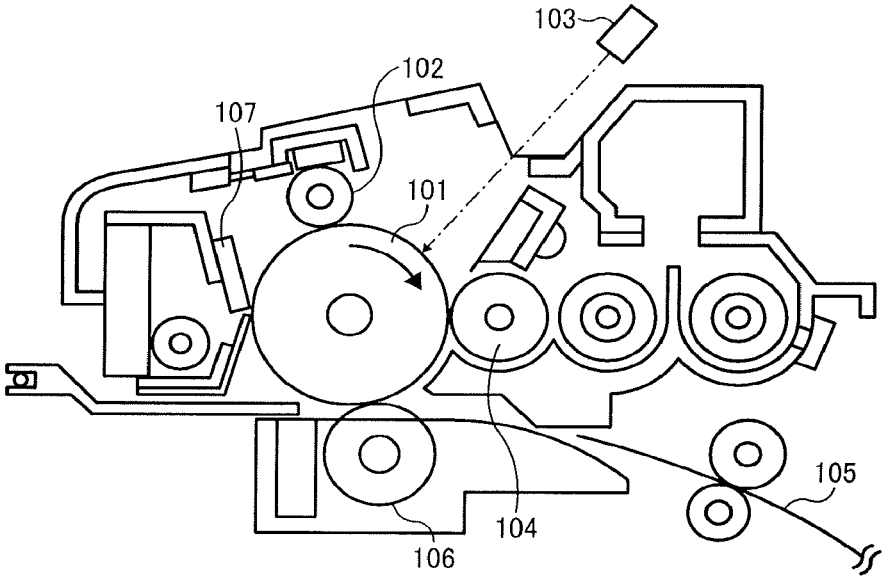
FIG. 6 is a schematic view of a process cartridge according to an embodiment of the present invention.

The process cartridge according to an embodiment of the present invention is detachably mountable on an image forming apparatus, and includes the photoconductor according to an embodiment of the present invention and at least one of a charger, a developing device, a transfer device, and a cleaner. FIG. 6 is a schematic view of a process cartridge according to an embodiment of the present invention.

The process cartridge integrally supports a photoconductor 101 according to an embodiment of the present invention, a charger 102, a developing device 104, a transfer device 106, and a cleaner 107. The process cartridge is detachably mountable on an image forming apparatus.

While the photoconductor 101 is rotating in a direction indicated by arrow in FIG. 6, the charger 102 charges a surface of the photoconductor 101 and an irradiator 103 emits light to the charged surface of the photoconductor 101, to form an electrostatic latent image on the surface of the photoconductor 101. The developing device 104 develops the electrostatic latent image into a toner image. The transfer device 106 transfers the toner image onto a transfer medium 105. The transfer medium 105 having the toner image thereon is printed out. After the image transfer, the cleaner 107 cleans the surface of the photoconductor 101 and a neutralizer neutralizes the surface of the photoconductor 101. These operations are repeatedly performed.

The photoconductor according some embodiments of the present invention may be applied to various fields, such as the fields of electrophotographic image forming apparatuses, laser beam printers, CRT printers, LED printers, liquid crystal printers, and laser plate making.

EXAMPLES

Example 1

An aluminum cylinder having a diameter of 30 mm was subjected to a polishing processing. Specifically, an end part of an inner circumferential surface of the aluminum cylinder, extending for a distance of 50 mm from one end, was subjected to a polishing processing to have a surface roughness Rz of 3.2 μm. Thus, a conductive support was prepared.

Figure 2:
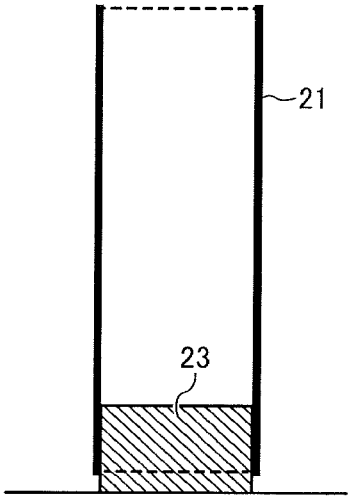
FIG. 2 is an illustration for explaining a method of forming a water-repellent resin film on an inner circumferential surface of an end part of the cylindrical conductive support illustrated in FIG. 1.

Next, a fluororesin (FG-50205135 available from Fluoro Technology Co., Ltd.)

was applied to the processed part of the inner circumferential surface of the aluminum cylinder using the equipment illustrated in FIG. 2, and thereafter dried at 150° C. for 30 minutes. Thus, a fluororesin film having a thickness of 0.3 μm was formed on the inner circumferential surface of the aluminum cylinder.

Next, an undercoat layer coating liquid, a charge generation layer coating liquid, and a charge transport layer coating liquid (each having the compositions listed below), in this order, were successively applied to an outer circumferential surface of the aluminum cylinder using the equipment illustrated in FIG. 3 and thereafter dried. Thus, an undercoat layer, a charge generation layer, and a charge transport layer, respectively having thicknesses of 3.0 μm, 0.2 μm, and 24 μm, were formed.

Composition of Undercoat Layer Coating Liquid

Alkyd resin (BECKOSOL 1307-60-EL available from DIC Corporation): 6 parts by mass Melamine resin (SUPER BECKAMINE G-821-60 available from DIC Corporation): 4 parts by mass Titanium oxide (CR-EL available from Ishihara Sangyo Kaisha, Ltd.): 40 parts by mass Methyl ethyl ketone: 50 parts by mass Composition of Charge Generation Layer Coating Liquid Titanyl phthalocyanine pigment having the following formula (A): 1.5 parts by mass Formula (A)

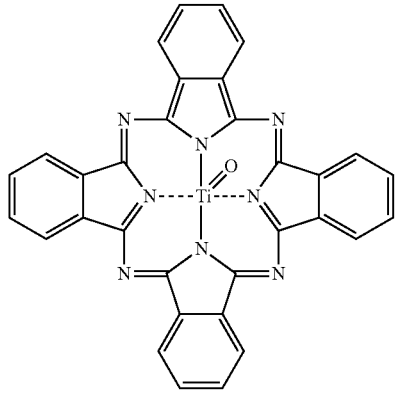

Polyvinyl butyral (BX-1 available from Sekisui Chemical Co., Ltd.): 1.0 part by mass Methyl ethyl ketone: 80 parts by mass Composition of Charge Transport Layer Coating Liquid Bisphenol Z polycarbonate (PANLITE® TS-2050 available from Teijin Chemicals Ltd.): 10 parts by mass Low-molecular-weight charge transport material having the following formula (B): 7 parts by mass Formula (B)

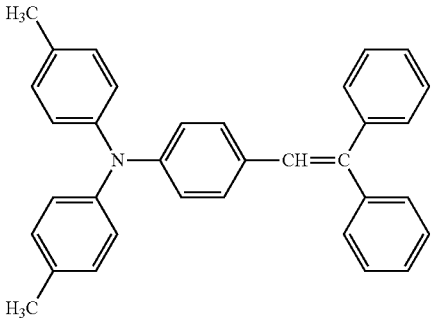

Tetrahydrofuran: 100 parts by mass

1% Tetrahydrofuran solution of silicone oil (KF50-100CS available from Shin-Etsu Chemical Co., Ltd.): 0.2 parts by mass Next, 0.05 g of an adhesive (ARON ALPHA 802 available from Toagosei Co., Ltd.) was applied to the inner circumferential surface of the end part of the aluminum cylinder, after the undercoat layer, charge generation layer, and charge transport layer had been formed on the outer circumferential surface thereof. A flange made of polyacetal was secured to the inner circumferential surface of the end part of the aluminum cylinder with the adhesive.

Evaluations

Evaluation of Fouling on Inner Circumferential Surface

Before attaching a flange to the conductive support, the conductive support was visually observed to determine whether the inner circumferential surface of the end part thereof, to be brought into contact with the flange, had a fouling or not.

In Table 1-1, "Good" indicates that no fouling was observed, and "Poor" indicates that a fouling was observed.

Evaluation of Torque Resistance

A heat cycle in which the photoconductor (including the flange) was cooled at −20° C. for 2 hours and heated at 50°

C. for 2 hours was repeated 5 times. The photoconductor was thereafter subjected to a torque resistance test under 150° C., 15% RH.

Evaluation of Durability

After being subjected to the above heat cycle 5 times, the photoconductor was mounted on a monochrome printer (IMAGIO SP6450 available from Ricoh Co., Ltd.) that had been partially modified. The photoconductor was subjected to a durability test by causing the printer to output a monochrome halftone test chart having an image area ratio of 5% on continuous 10,000 sheets under 10° C., 15% RH. After the durability test, image evaluation was performed. In addition, visual determination on whether idle rotation of the flange had occurred or not was performed.

With respect to the results for image evaluation in Table 1-2, "Good" indicates that no abnormal image was observed.

With respect to the results for determination of idle rotation of the flange in Table 1-2, "Good" indicates that no idle rotation of the flange was observed, and "Poor" indicates that an idle rotation of the flange was observed.

Example 2

The procedure in Example 1 was repeated except that the inner circumferential surface of the end part of the aluminum cylinder was processed to have a surface roughness Rz of 5.4 μm.

Example 3

The procedure in Example 1 was repeated except that the inner circumferential surface of the end part of the aluminum cylinder was processed to have a surface roughness Rz of 6.8 μm.

Example 4

The procedure in Example 1 was repeated except that the inner circumferential surface of the end part of the aluminum cylinder was processed to have a surface roughness Rz of 7.8 μm.

Example 5

The procedure in Example 1 was repeated except that the inner circumferential surface of the end part of the aluminum cylinder was processed to have a surface roughness Rz of 9.5 μm.

Example 6

The procedure in Example 1 was repeated except that a resin liquid having the following composition was applied to the processed part of the inner circumferential surface of the aluminum cylinder, in place of the fluororesin.

Resin Liquid

Nylon resin (CM8000 available from Toray Industries, Inc.): 5 parts by mass Methanol: 70 parts by mass 1-Butanol: 30 parts by mass 1% methanol solution of silicone oil (KF96-100CS available from Shin-Etsu Chemical Co., Ltd.): 2.5 parts by mass Example 7

The procedure in Example 6 was repeated except that the inner circumferential surface of the end part of the aluminum cylinder was processed to have a surface roughness Rz of 9.5 μm.

Comparative Example 1

The procedure in Example 2 was repeated except that the inner circumferential surface of the aluminum cylinder was wiped with a solvent without forming the fluororesin film thereon, the undercoat layer and the charge generation layer were wiped with methyl ethyl ketone, and the charge transport layer was wiped with tetrahydrofuran.

Comparative Example 2

The procedure in Example 2 was repeated except that the inner circumferential surface of the aluminum cylinder was wiped with a solvent without forming the fluororesin film thereon.

Comparative Example 3

The procedure in Example 1 was repeated except that the inner circumferential surface of the aluminum cylinder was not processed. As a result, the inner circumferential surface had a surface roughness Rz of 0.8 μm.

Comparative Example 4

The procedure in Example 1 was repeated except that the inner circumferential surface of the end part of the aluminum cylinder was processed to have a surface roughness Rz of 12.3 μm.

Details for the above-prepared photoconductors are described in Tables 1-1 and 1-2.

The evaluation results are also described in Tables 101 and 1-2.

TABLE 1-1

| | Rz (μm) | Water-repellent Resin Film | Wiping with Solvent | Fouling on Inner Circumferential Surface |
|---|---|---|---|---|
| Example 1 | 3.2 | Fluororesin | No | Good |
| Example 2 | 5.4 | Fluororesin | No | Good |
| Example 3 | 6.8 | Fluororesin | No | Good |
| Example 4 | 7.8 | Fluororesin | No | Good |
| Example 5 | 9.5 | Fluororesin | No | Good |
| Example 6 | 3.2 | Silicone-based Resin | No | Good |
| Example 7 | 9.5 | Silicone-based Resin | No | Good |
| Comparative Example 1 | 5.4 | None | Yes | Good |
| Comparative Example 2 | 5.4 | None | No | Poor |
| Comparative Example 3 | 0.8 (no processing) | Fluororesin | No | Good |
| Comparative Example 4 | 12.3 | Fluororesin | No | Good |

TABLE 1-2

| | Torque | Durability | | |
|---|---|---|---|---|
| | | Image Evaluation | | |
| | Resistance (N · m) | Initial Stage | After Durability Test | Idle Rotation of Flange |
| Example 1 | 3.8 | Good | Good | Good |
| Example 2 | 5.1 | Good | Good | Good |
| Example 3 | 5.8 | Good | Good | Good |
| Example 4 | 5.5 | Good | Good | Good |
| Example 5 | 4.5 | Good | Good | Good |
| Example 6 | 3.4 | Good | Good | Good |
| Example 7 | 3.2 | Good | Good | Good |
| Comparative Example 1 | 4.5 | Image unevenness on lower end | Image unevenness on lower end | Poor |
| Comparative Example 2 | 0.8 | Good | Image shrinking | Good |
| Comparative Example 3 | 4.4 | Image unevenness | Image unevenness | Good |
| Comparative Example 4 | 0.9 | Good | Image shrinking | Poor |

It is clear from Tables 1-1 and 1-2 that the photoconductors of Examples 1 to 7 have no fouling on the inner circumferential surface of the aluminum cylinder. In addition, these photoconductors have sufficient torque resistance. Moreover, these photoconductors produce no abnormal image and cause no idle rotation of the flange. These results indicate that these photoconductors according to some embodiments of the present invention can output high quality image for an extended period of time even after a repeated use.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A photoconductor comprising:

a cylindrical conductive support having an end part having an inner circumferential surface having a surface roughness Rz of from 3 to 10 μm, the end part having an outer circumferential surface;

a water-repellent resin film on the inner circumferential surface of the end part of the cylindrical conductive support;

a coating film on an outer circumferential surface of the cylindrical conductive support; and a flange having a cylindrical fitting part having an outer circumferential surface secured to the inner circumferential surface of the end part of the cylindrical conductive support, wherein the water-repellent resin film is disposed only on the inner circumferential surface of the end part of the cylindrical conductive support.

2. The photoconductor of claim 1, wherein the water-repellent resin film includes fluororesin.

3. The photoconductor of claim 1, wherein the outer circumferential surface of the cylindrical fitting part of the flange is secured to the inner circumferential surface of the end part of the cylindrical conductive support with an adhesive.

4. The photoconductor of claim 1, wherein the flange includes polyacetal.

5. An image forming apparatus comprising:

the photoconductor of claim 1;

a charger to charge a surface of the photoconductor;

an irradiator to irradiate the charged surface of the photoconductor to form an electrostatic latent image thereon;

a developing device to develop the electrostatic latent image with a toner to form a toner image;

a transfer device to transfer the toner image from the photoconductor onto a recording medium; and a fixing device to fix the toner image on the recording medium.

6. A process cartridge detachably mountable on an image forming apparatus, comprising:

the photoconductor of claim 1; and at least one of a charger, a developing device, a transfer device, and a cleaner.

7. A method of manufacturing a photoconductor, comprising:

processing an inner circumferential surface of an end part of a cylindrical conductive support to have a surface roughness Rz of from 3 to 10 μm, the end part having an outer circumferential surface;

forming a water-repellent resin film on the inner circumferential surface of the end part of the cylindrical conductive support;

forming a coating film on an outer circumferential surface of the cylindrical conductive support; and securing an outer circumferential surface of a cylindrical fitting part of a flange to the inner circumferential surface of the end part of the cylindrical conductive support, wherein the water-repellent resin film is disposed only on the inner circumferential surface of the end part of the cylindrical conductive support.

* * * * *